US006273538B1

(12) United States Patent
Mitsuhashi et al.

(10) Patent No.: US 6,273,538 B1
(45) Date of Patent: Aug. 14, 2001

(54) METHOD OF DRIVING INK-JET HEAD

(75) Inventors: Tadashi Mitsuhashi; Shinichi Komine, both of Tokorozawa (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/403,303

(22) PCT Filed: Apr. 30, 1998

(86) PCT No.: PCT/JP98/01985

§ 371 Date: Oct. 20, 1999

§ 102(e) Date: Oct. 20, 1999

(87) PCT Pub. No.: WO99/14050

PCT Pub. Date: Apr. 25, 1999

(30) Foreign Application Priority Data

Sep. 12, 1997 (JP) ..... 9-248553

(51) Int. Cl.[7] ..... B41J 29/38
(52) U.S. Cl. ..... 347/11
(58) Field of Search ..... 347/11, 10, 9, 347/68, 69

(56) References Cited

U.S. PATENT DOCUMENTS

| | | | | |
|---|---|---|---|---|
| 3,946,398 | | 3/1976 | Kyser et al. | 347/70 |
| 4,609,925 | * | 9/1986 | Nozu et al. | 347/27 |
| 4,887,100 | | 12/1989 | Michaelis et al. | 347/69 |
| 4,897,665 | * | 1/1990 | Aoki | 347/10 |
| 5,426,454 | | 6/1995 | Hosono et al. | 347/9 |
| 5,576,743 | * | 11/1996 | Momose et al. | 347/11 |
| 5,764,247 | * | 6/1998 | Asai | 347/10 |
| 5,821,953 | * | 10/1998 | Nakano et al. | 347/10 |
| 5,984,448 | * | 11/1999 | Yanagawa | 347/10 |
| 6,074,033 | * | 6/2000 | Sayama et al. | 347/10 |
| 6,095,630 | * | 8/2000 | Horii et al. | 347/10 |
| 6,106,091 | * | 8/2000 | Osawa et al. | 347/9 |

FOREIGN PATENT DOCUMENTS

| | | | | |
|---|---|---|---|---|
| 57-105361 A | * | 6/1982 | (JP) | 347/10 |
| 1-278358 | | 11/1989 | (JP) . | |
| 7-178907 | | 7/1995 | (JP) . | |
| WO97/18953 | | 5/1997 | (WO) . | |

* cited by examiner

*Primary Examiner*—Judy Nguyen
(74) *Attorney, Agent, or Firm*—Finnegan, Henderson, Farabow, Garrett & Dunner, L.L.P.

(57) ABSTRACT

In a method for driving an ink jet head in which at least a portion of a wall surface of an ink chamber is deformed by a piezoelectric actuator to eject ink, the voltage applied to the piezoelectric actuator is lowered from a voltage value in an initial condition, thereby causing the volume of the ink chamber to increase and thus causing ink to be drawn into the ink chamber, and then the applied voltage is rapidly raised up to a prescribed voltage value higher than the initial condition voltage value, thereby causing the volume of the ink chamber to decrease and thus causing ink to be ejected from the ink chamber. Next, after holding the prescribed voltage value for a prescribed length of time, the applied voltage is caused to drop from the prescribed voltage value down to the initial condition voltage value, thereby causing the volume of the ink chamber to increase. The time over which the applied voltage is dropped is set equal to one half the cycle of meniscus surface tension oscillations caused by the ink ejection, and the voltage drop value is set at such a value at to generate, in the ink chamber, oscillations corresponding to the amplitude of the meniscus surface tension oscillations.

3 Claims, 6 Drawing Sheets

METHOD OF DRIVING INK-JET HEAD

TECHNICAL FIELD

The present invention relates to a method for driving a piezoelectric ink jet head which selectively makes ink droplets adhere to an image recording medium.

BACKGROUND ART

Among nonimpact printers, which are rapidly expanding their market share, the one that is the simplest in principle and most suitable for color printing is the ink jet printer.

Regarding this type of printer, it can be said that the so-called drop-on-demand type that ejects ink droplets only when forming dots is predominant. Many types of drop-on-demand piezoelectric ink jet heads that use piezoelectric elements have been disclosed and are represented by the Kyser type disclosed, for example, in Japanese Examined Patent Publication No. 53-12138, the layered piezoelectric actuator type disclosed, for example, in Japanese Unexamined Patent Publication No. 6-4327, and the shear mode type disclosed, for example, in Japanese Unexamined Patent Publication No. 63-252750.

In such a piezoelectric ink jet head, a piezoelectric element deformable by the application of a pulse waveform is mounted at least on a portion of the wall surface of an ink chamber which communicates at one end with a nozzle and at the other end with an ink reservoir, and ink is ejected by deforming this piezoelectric element.

The piezoelectric ink jet head is usually driven in the following way. First, a pulse waveform is applied to the piezoelectric element to deform the portion of the wall surface of the ink chamber in such a manner as to cause the internal volume of the ink chamber to increase and thereby draw ink into the ink chamber. Next, by either removing the voltage from the piezoelectric element or applying a pulse waveform opposite in polarity to the first applied pulse waveform, the portion of the wall surface of the ink chamber is deformed in a direction opposite from the direction in which it was first deformed. This causes the internal volume of the ink chamber to decrease, and an ink droplet is ejected. This is the so-called draw-and-fire driving method.

With the above method, however, oscillations will remain on the ink meniscus after the ink droplet is ejected. The residual oscillations consist of pressure wave oscillations due to the mechanical structure of the ink chamber itself and hydrodynamic surface tension oscillations of the ink itself.

If the next ink eject action is attempted while these oscillations remain, the meniscus oscillations caused by its ink ejection driving are superimposed on the residual oscillations of the meniscus caused by the previous ejection. This causes a difference in meniscus position between the current ink ejection and the previous ink ejection, as a result of which the size and ejection speed of the ink droplet vary and stable ink ejection cannot be accomplished.

The higher the ink ejection speed, the more accurately can the ink dot be deposited. Further, if the voltage applied for ink ejection is the same, the shorter the ink ejection time, the higher the ink ejection speed.

The residual oscillations of the meniscus can be suppressed by setting the length of the ink ejection time equal to the cycle of the pressure wave oscillations occurring due to pressure changes in the ink chamber.

However, if the length of the ink ejection time is set equal to the cycle of the pressure wave oscillations to suppress the residual oscillations, this in turn imposes a restriction on the ejection speed. On the other hand, if a high ink ejection speed is to be obtained while suppressing the residual oscillations occurring after ink ejection, the natural frequency of oscillation of the ink chamber itself must be increased. Since this demands a change in head size, freedom in head design is limited.

DISCLOSURE OF THE INVENTION

It is accordingly an object of the present invention to provide an ink jet head driving method that can achieve the desired ink droplet ejection performance independently of the natural frequency of oscillation of the head, and that can deliberately control the residual oscillations of the meniscus caused by the ejection of an ink droplet.

To achieve the above object, according to the ink jet head driving method of the present invention, first the voltage applied to the piezoelectric actuator is lowered from a voltage value in an initial condition, thereby causing the volume of the ink chamber to increase and thus causing ink to be drawn into the ink chamber. Thereafter, the applied voltage is rapidly raised to a prescribed voltage higher than the initial condition voltage value, thereby causing the volume of the ink chamber to decrease and thus causing ink to be ejected from the ink chamber. Next, the prescribed voltage value is held for a prescribed length of time until the meniscus returns to its initial position, after which the applied voltage is lowered from the prescribed voltage value to the initial condition voltage value, thereby causing the volume of the ink chamber to increase. Here, the time over which the applied voltage is lowered from the prescribed voltage value to the initial condition voltage value is equal to one half the cycle of meniscus surface tension oscillations caused by the ink ejection, and the difference between the prescribed voltage value and the initial condition voltage value is such that oscillations corresponding to the amplitude of the meniscus surface tension oscillations are generated in the ink chamber.

Further, the step of lowering the voltage applied to the piezoelectric actuator from the initial condition voltage value consists of two steps wherein, in the first step, the voltage is rapidly lowered and, in the second step, the voltage is lowered more slowly than in the first step.

ADVANTAGEOUS EFFECT OF THE INVENTION

According to the ink jet head driving method of the present invention, since the residual oscillations of the meniscus after ink ejection can be quickly damped and the meniscus be brought back to its initial condition in a short period of time by lowering the driving voltage after the ink ejection, stable print quality, unaffected by the driving frequency, can be obtained.

Further, the voltage in the initial condition is set lower than the maximum application voltage required for ink ejection in order to suppress the oscillation of the meniscus. Accordingly, the meniscus drawing action performed to control the ink ejection amount is prevented from becoming excessive; as a result, the ink supply time required to obtain the desired amount of ink can be shortened, achieving efficient driving for ink ejection. Furthermore, since leakage current between the electrodes of the piezoelectric actuator can be reduced to a low level, the power consumption of the ink jet apparatus as a whole can be reduced.

DETAILED DESCRIPTION OF THE INVENTION

An ink jet head driving method according to the present invention will be described below by way of examples.

Figure 1:
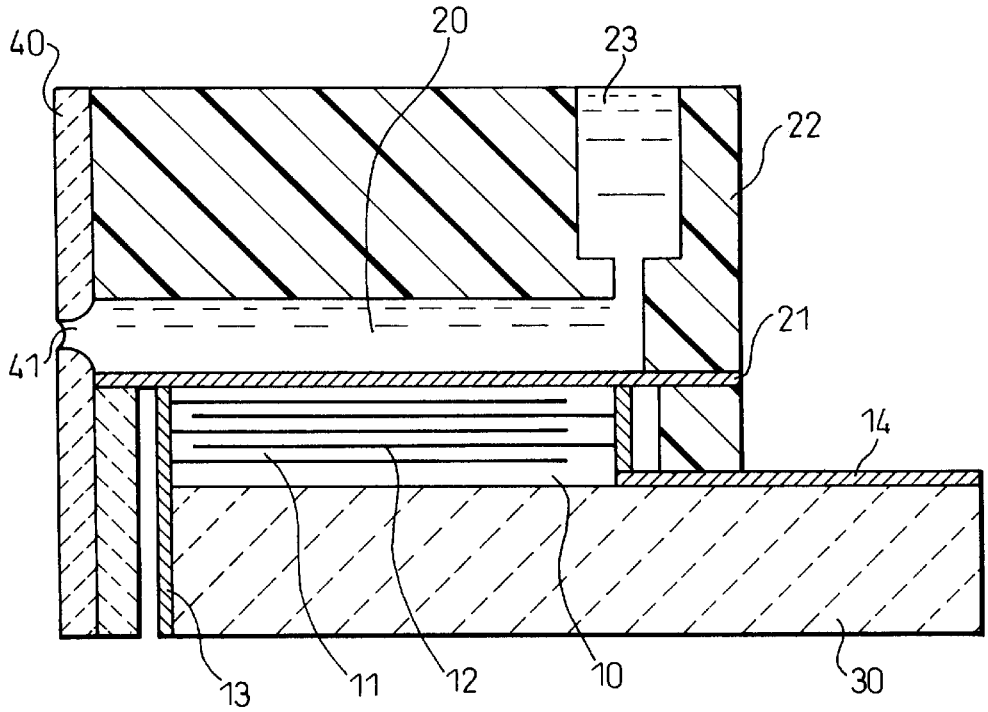
FIG. 1 is a cross-sectional side view showing an embodiment of an ink jet head used in the present invention.
Figure 2:
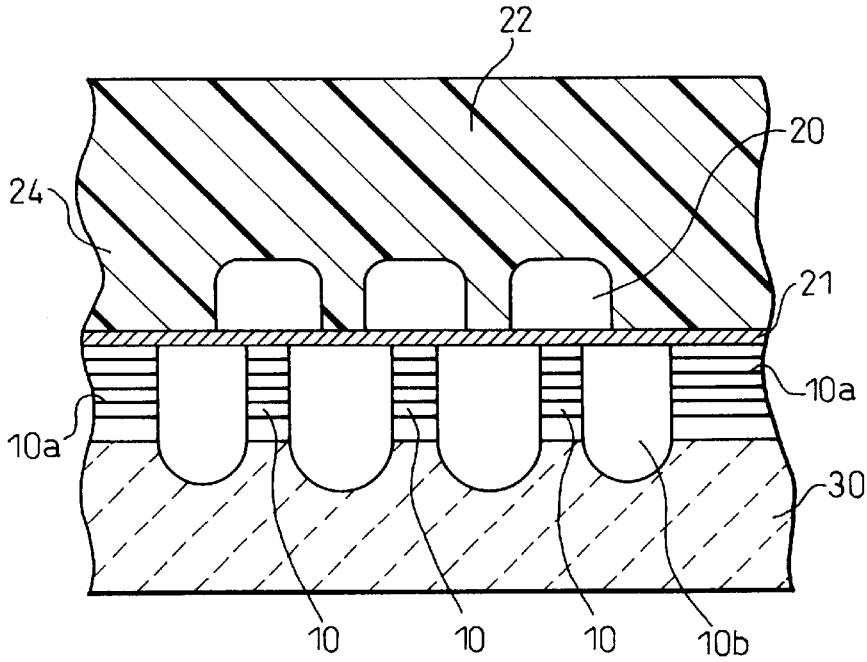
FIG. 2 is a cross-sectional front view of the ink jet head according to the embodiment of the present invention as viewed from the nozzle side thereof.

FIGS. 1 and 2 show the structure of an ink jet head to which the driving method of the present invention is applied. FIG. 1 illustrates a cross-sectional view of the ink jet head according to the present invention, and FIG. 2 presents a cross-sectional front view of the ink jet head according to the present invention as viewed from the nozzle side thereof.

The ink jet head includes layered-type piezoelectric actuators 10 having a piezoelectric distortion constant d33 and operated to deform their associated ink chambers 20. More specifically, in the ink jet head, the piezoelectric actuators 10, each consisting of alternate layers of piezoelectric material 11 polarized in the thickness direction and conductive material 12, are glued to the upper surface of a substrate 30 and are spaced apart from another by a prescribed distance.

Collector electrodes 13 and 14 are respectively formed on the front and back end faces of each piezoelectric actuator 10. When a voltage is applied between the collector electrodes 13 and 14, the piezoelectric actuator 10 is deformed in its thickness direction (direction of d33).

A thin vibrating plate 21 is glued to the upper surfaces of the piezoelectric actuators 10, and a channel member 22 is glued to the upper surface of the vibrating plate 21. The ink chambers 20 are formed at uniformly spaced intervals in the channel member 22, the ink chambers 20 being disposed opposite their associated piezoelectric actuators 10 on the other side of the vibrating plate 21. Each ink chamber 20 has an ink supply port 23 which is connected to an ink cartridge (not shown) serving as an ink supply source.

The front end faces of the substrate 30 and piezoelectric actuators 10 with the collector electrode 13 formed thereon are made flush with the front end faces of the vibrating plate 21 and channel member 22, and a nozzle plate 40 is glued to these end faces. A plurality of nozzle holes 41 are formed in the nozzle plate 40. These nozzle holes 41 communicate with the respective ink chambers 20 formed in the channel member 22. Accordingly, when ink from the ink cartridge is filled into an ink chamber 20, a meniscus is formed within its nozzle hole 41.

As shown in FIG. 2, each piezoelectric actuator 10 glued to the substrate 30 is constructed by forming grooves 10*a* thereon using a wire saw or blade saw, and is disposed facing its associated ink chamber formed in the channel member 22. Piezoelectric actuators 10*a* are not operated but serve as supports.

Next, a description will be given of the driving voltage waveform applied to the piezoelectric actuator 10 and the displacement of the piezoelectric actuator 10.

Figure 3:
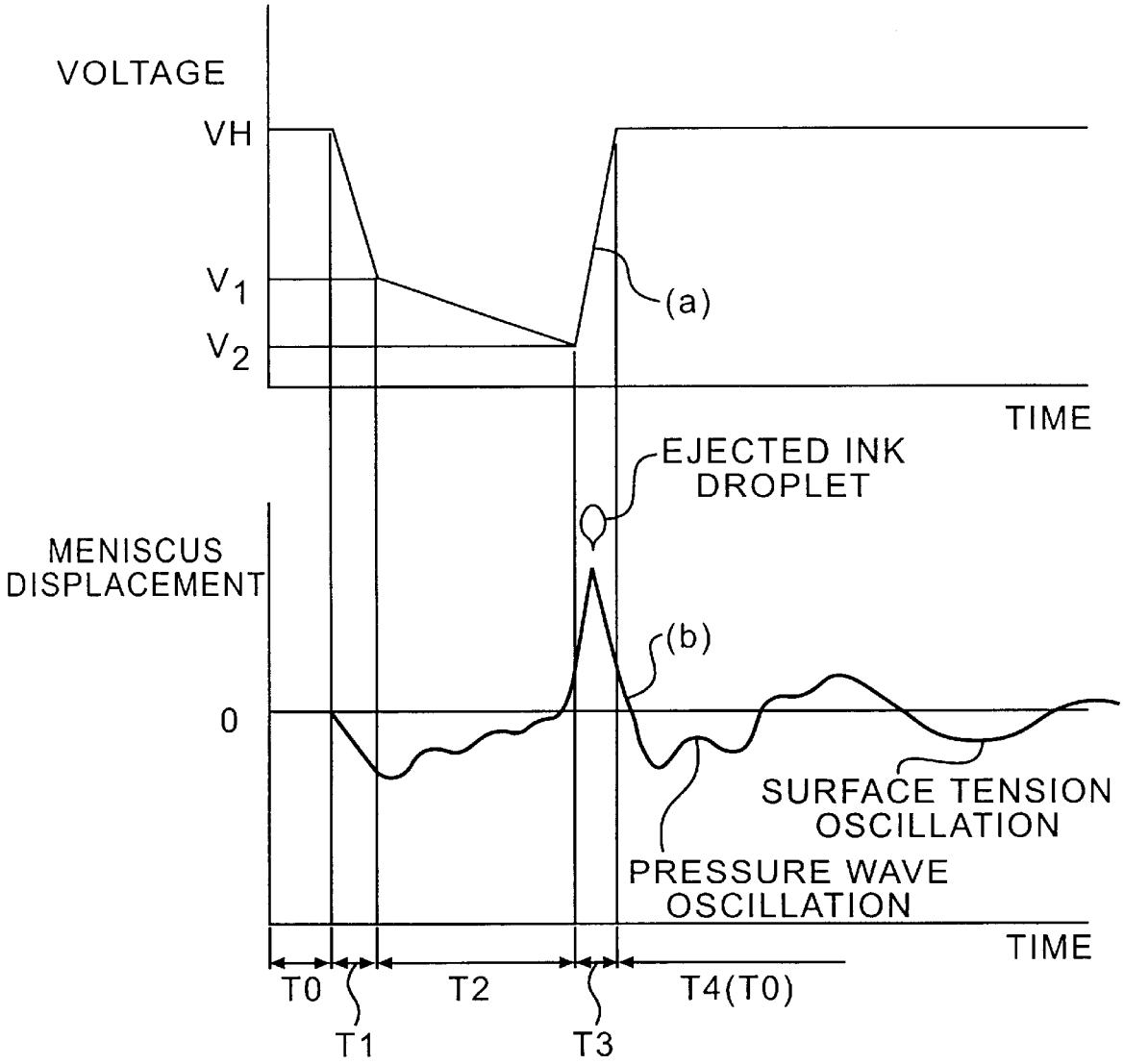
Fig.3 PRIOR ART
FIG. 3 is a waveform diagram showing a driving waveform applied to a piezoelectric actuator and oscillatory displacement of the meniscus in accordance with a conventional art example.
Figure 4A:
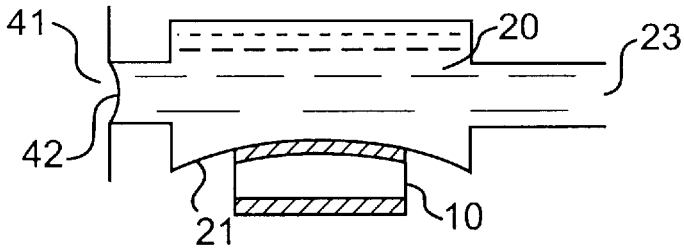
FIGS. 4(*a*)–(*d*) are sequence diagrams illustrating the operating principle of the ink jet head used in the present invention.
Figure 4B:
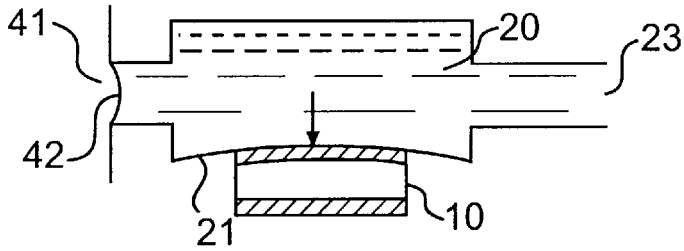
Figure 4C:
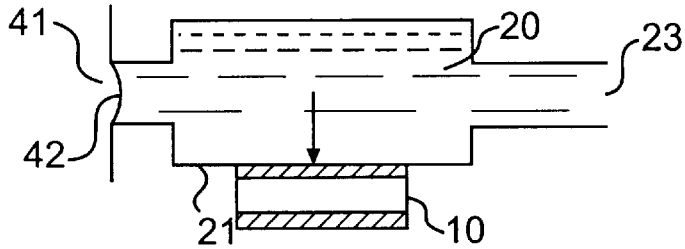
Figure 4D:
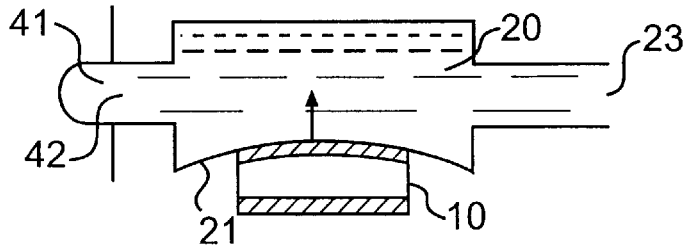

FIG. 3 is a waveform diagram showing the driving voltage waveform applied to the piezoelectric actuator and oscillatory displacement of the meniscus. In FIG. 3, (a) shows the driving voltage waveform for driving the piezoelectric actuator, and (b) depicts a waveform showing the oscillatory displacement of the meniscus during the application of the driving voltage.

As shown in FIG. 3, the voltage of the driving waveform is held at VH during first time T0. At this time, the piezoelectric actuator is deformed in such a direction as to constrict the ink chamber, and the meniscus is held in an equilibrium condition at the tip of the nozzle hole.

When the driving voltage is reduced from VH to V1 over second time T1, causing the piezoelectric actuator to deform in such a direction as to expand the ink chamber, the meniscus moves toward the inside of the ink chamber.

Then, when the driving voltage is reduced to V2 over third time T2 at a slower rate than in the second time T1, causing the piezoelectric actuator to slowly deform in such a direction as to expand the ink chamber, the meniscus moves forward toward the nozzle hole with its own surface tension oscillations, thereby drawing ink from the ink supply side into the ink chamber.

Next, when the driving voltage is rapidly raised to the initial voltage VH over fourth time T3, the piezoelectric actuator is rapidly deformed in the direction that constricts the ink chamber. This increases the internal pressure of the ink chamber, causing the meniscus to protrude in a convex form outside the nozzle hole and thus form an ink droplet which is ejected from the nozzle hole.

FIG. 4 is a sequence of diagrams for explaining the operating principle of the ink jet head in detail. Part (a) shows the condition during the initial time T0 in FIG. 3. Part (b) shows the condition during the first ink supply time T1 in FIG. 3. Part (c) shows the condition during the second ink supply time T2 in FIG. 3. Part (d) shows the condition during the third ink eject time T3 in FIG. 3. During the settling time T4 in FIG. 3, the condition gradually settles down to the initial condition of FIG. 4(*a*). The five time intervals consisting of the initial time T0, the first ink supply time T1, the second ink supply time T2, the ink eject time T3, and the settling time T4 constitute one print cycle. A print standby time may or may not be inserted between the settling time T4 and the initial time T0 of the next print cycle.

Next, the basic operation of the ink jet driving will be described in detail with reference to FIGS. 3 and 4.

During the initial time T0 shown in FIG. 3, the driving voltage applied to the piezoelectric actuator 10 is maximum, i.e., at the supply voltage VH. During this time interval, the piezoelectric actuator 10 is deformed in the most expanded state in its thickness direction, as shown in FIG. 4(*a*), pushing up the vibrating plate 21 and reducing the volume of the ink chamber 20 to a minimum.

At this time, the meniscus 42, which is an ink/air interface formed within the nozzle hole 41, is slightly concave and maintains its equilibrium in this state. Further, the charge stored in the piezoelectric actuator 10, which is electrically equivalent to a capacitance, is maximum.

During the first ink supply time T1, the first supply voltage of the rapidly decreasing voltage waveform is applied to the piezoelectric actuator 10. Then, a large discharge current flows in the piezoelectric actuator 10, rapidly reducing the charge and, as a result, as shown by arrow in FIG. 4(*b*), the thickness decreases compared to its condition during the initial time, causing a sudden displacement in such a direction as to increase the volume of the ink chamber 20.

The deformation of the piezoelectric actuator 10 causes deformation of the vibrating plate 21 of the ink chamber 20, thus causing the meniscus 42 formed within the nozzle hole 41 to be drawn inside. At the same time, ink is drawn into the ink chamber 20 from the ink supply source via the ink supply port 23.

During the first ink supply time T1, the ink is quickly and surely drawn into the ink chamber 20, but as the first ink supply time T1 ends, free oscillations with the oscillations of the ink itself superimposed on the natural oscillations of the piezoelectric actuator 10 occur on the meniscus 42 and in the ink in the ink chamber 20.

Next, during the second ink supply time T2, the voltage waveform for the second ink supply, exhibiting a slower voltage change than that of the first ink supply voltage waveform applied during the first ink supply period T1, is applied as the driving voltage to the piezoelectric actuator 10. As a result, a discharge current flows in the piezoelectric actuator 10, slowly reducing the charge, and the piezoelectric actuator 10 returns to its original nondeformed shape, as shown in FIG. 4(*c*), causing the internal volume of the ink chamber 20 to slowly increase.

At this time, the slow restoration of the piezoelectric actuator 10 from its deformed shape during the second ink supply time T2 proceeds so as to suppress the amplitude of the free oscillations occurring after the first ink supply time T1 (this effect is hereinafter referred to as the "damping effect"), and the amplitude of the oscillations of the ink itself in the ink chamber 20 is also reduced by this damping effect.

The damping effect for the free oscillations of the piezoelectric actuator 10 and ink becomes pronounced when the length of the second ink supply time T2 is set approximately equal to an integral multiple of the natural frequency of oscillation of the piezoelectric actuator 10.

Next, during the ink eject time T3, a rapidly increasing driving voltage is applied to the piezoelectric actuator 10. As a result, the piezoelectric actuator 10 rapidly charges and expands rapidly in its thickness direction, as shown by arrow in FIG. 4(*d*), causing a sudden displacement in such a direction as to reduce the internal volume of the ink chamber 20 that was increasing during the first ink supply time T1 and second ink supply time T2. This sudden decrease in the internal volume of the ink chamber 20 causes a rapid increase in the internal pressure of the ink chamber 20, as a result of which the meniscus 42 is caused to protrude outside the nozzle hole 41, and an ink droplet is thus formed.

The settling time T4 is the period during which the free oscillations occurring at the end of the ink eject time T3 are damped to restore the initial condition.

In the waveform shown in FIG. 3, the driving waveform is brought back to the initial voltage during the fifth time T4 (T0), but the oscillations caused by the ejection of the ink droplet during the fourth time T3 remain on the meniscus. These residual oscillations consist of pressure wave oscillations due to the mechanical structure of the ink chamber itself and the hydrodynamic surface tension oscillations of the ink itself.

If the next ink eject action is attempted while these oscillations remain, the meniscus oscillations caused by the ink jet driving are superimposed on the residual oscillations of the meniscus caused by the previous ejection, as previously explained, so that a difference arises in meniscus position between the current ink ejection and the previous ink ejection. As a result, the size and ejection speed of the ink droplet vary and a stable ink eject action cannot be accomplished.

In view of this, the present invention provides an ink jet head driving method which controls positively the residual oscillations of the meniscus resulting from an ink droplet ejection so that the desired ink droplet ejection performance can be achieved.

In the driving method that uses the driving voltage waveform shown in FIG. 3, the amount of ink drawn during the times T1 and T2 is determined by the amount of change of the applied voltage dropping from VH at the first time T0 to V1 and V2 and by the length of the ink drawing times T1 and T2. More specifically, the amount of ink drawn increases as the voltage VH is raised, increasing the amount of voltage change, and as the length of the times T1 and T2 is increased. However, if the voltage VH is high and the amount of change is large, the negative pressure generated during the time T1 becomes large; as a result, a specified amount of ink cannot be drawn unless the length of the drawing times T1 and T2 is made long in accordance with VH. On the other hand, if the voltage applied during the first time T0 is made lower than VH, the specified amount of ink can be drawn even if the length of the ink drawing times T1 and T2 is made shorter than when the voltage is set equal to VH.

As for the ink eject driving during the time T3, the ejection speed increases as the voltage VH is raised, increasing the amount of voltage change, and as the length of the time T3 decreases. As earlier stated, the higher the ink ejection speed, the more accurately can the ink dot be deposited.

Considering the above points, the present invention provides an ink jet head driving method capable of positively controlling the residual oscillations of the meniscus without decreasing ink droplet ejection speed.

Figure 5:
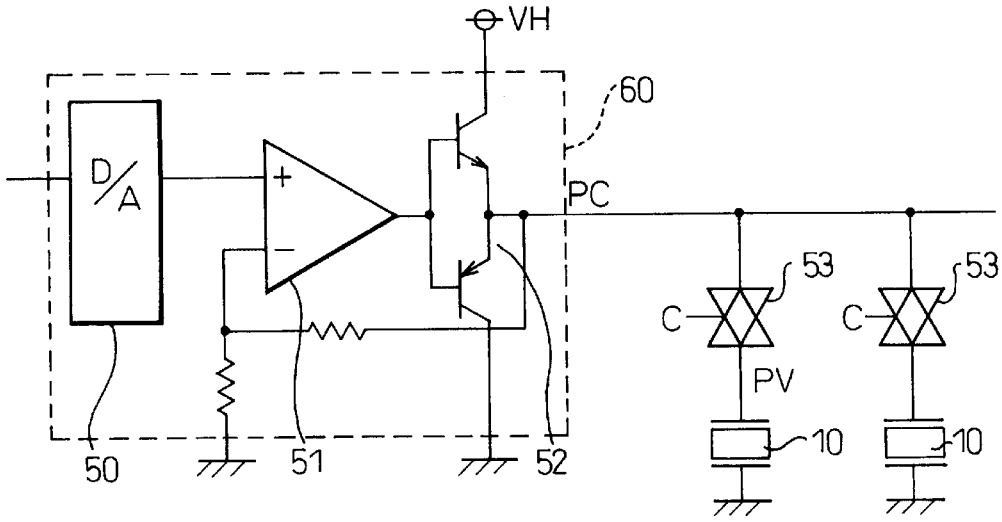
FIG. 5 is a diagram showing a circuit for implementing a method of driving the ink jet head used in the present invention.

FIG. 5 is a diagram showing the configuration of a driving circuit used in the method of the present invention to apply voltage to the piezoelectric actuators 10 in the ink jet head. The driving circuit comprises: a driving waveform generating circuit 60 consisting of a D/A converter 50, an operational amplifier 51, and a current amplifying transistor 52; transfer gates 53; and the piezoelectric actuators 10. In the driving waveform generating circuit 60, first the D/A converter 50 generates the basic driving voltage waveform which is then current-amplified by the operational amplifier 51 and output from the current amplifying transistor 52.

The common driving waveform signal PC output from the driving waveform generating circuit 60 is coupled to each transfer gate 53 whose ON/OFF operation is controlled by a control signal C. When the transfer gate 53 is ON, the driving voltage waveform is applied to the associated piezoelectric actuator 10 which is thus caused to deform.

Figure 6:
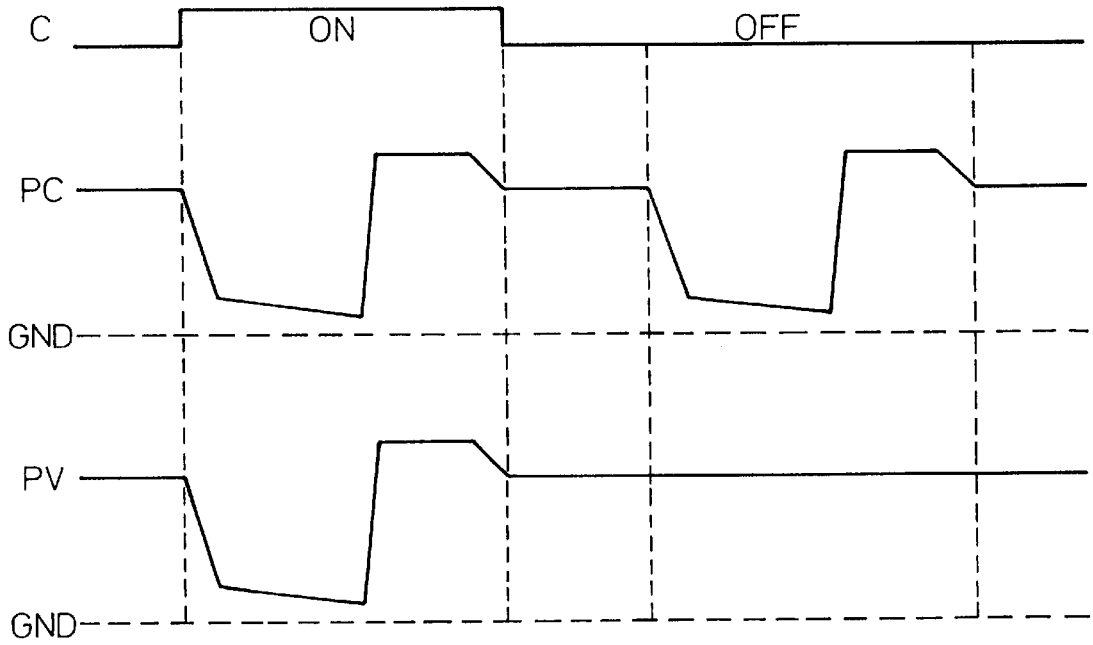
FIG. 6 is a diagram showing voltage waveforms at various parts of the driving circuit of FIG. 5.

FIG. 6 shows voltage waveforms at various parts of the driving circuit shown in FIG. 5. C is the control signal for controlling the ON/OFF operation of each transfer gate 53, and PC is the common driving voltage waveform output from the driving voltage waveform generating circuit 60. PV is the driving voltage waveform applied to the piezoelectric actuator 10 when the control signal C is ON.

Figure 7:
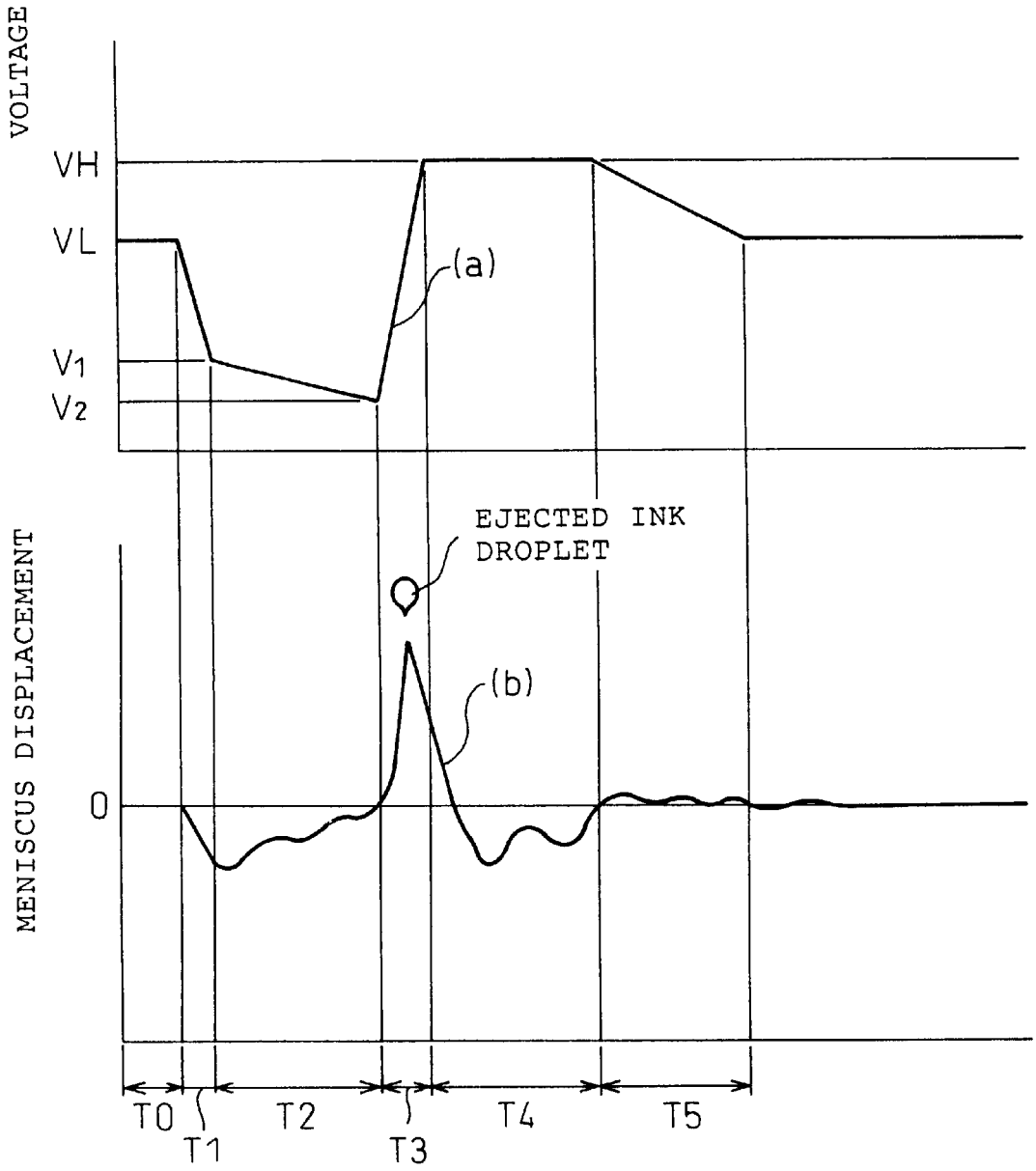
FIGS. 7 & 8 are waveform diagrams showing the driving waveform applied to the piezoelectric actuator when the ink jet head and driving circuit of the present invention are used, and the oscillatory displacement of the meniscus measured by using a laser Doppler vibrometer.

FIG. 7 is a waveform diagram showing the driving voltage waveform output from the driving circuit for application to the piezoelectric actuator in the ink jet head according to the method of the present invention, and the oscillatory displacement of the meniscus measured by using a laser Doppler vibrometer. In FIG. 7, (a) shows the driving voltage waveform applied to the piezoelectric actuator according to the present invention, and (b) depicts a waveform showing the oscillatory displacement of the meniscus during the application of the driving voltage.

During first time T0 which defines the initial condition, the piezoelectric actuator is supplied with a voltage VL lower than the maximum application voltage VH, as shown by (a), and is thus held in a charged condition. As shown by (b), the displacement of the meniscus is zero, that is, the meniscus formed at the tip of the nozzle hole is slightly concaved, and maintains its equilibrium in this state.

Next, during second time T1, the voltage applied to the piezoelectric actuator is rapidly lowered to V1. As a result, the piezoelectric actuator rapidly discharges, causing a sudden displacement in such a direction as to increase the volume of the ink chamber. This generates a negative pressure in the ink chamber, and in the meniscus recesses, by being drawn toward the inside of the ink chamber. At this time, as the length of the second time T1 is reduced, the negative pressure generated in the ink chamber increases, increasing the meniscus recess amount.

Next, during third time T2, the voltage applied to the piezoelectric actuator is lowered to V2. The voltage applied during the time T2 is of a voltage waveform having a gentler slope than the voltage applied during the second time T1. As a result, the piezoelectric actuator discharges slowly. This acts to inhibit the meniscus from being further drawn toward the inside of the ink chamber, and ink from the ink reservoir is drawn into the ink chamber through the ink supply port. Then, the meniscus begins to move toward the nozzle tip, so that the internal volume of the ink chamber increases. Generally, the speed of this meniscus movement is determined by the cycle of the surface tension oscillations of the meniscus, but in this case, the moving speed is controlled to a certain extent by changing the voltage slope of the third time T2, and the final ejection amount of the ink droplet is determined by the meniscus position which is determined by the length of the third time T2.

Next, during fourth time T3, the voltage applied to the piezoelectric actuator is rapidly raised to the voltage VH, thus charging the piezoelectric actuator. At this time, the charge amount of the piezoelectric actuator becomes maximum. As a result, the meniscus is caused to protrude outside the nozzle hole, and the ink droplet thus formed is ejected. As the fourth time T3 is made shorter, the ejection speed of the ink droplet from the nozzle hole increases.

During fifth time T4, the voltage VH attained at the end of the fourth time T3 is maintained and the piezoelectric actuator is held in the charged condition. At this time, the meniscus is vibrating (with surface tension oscillations accompanied by pressure wave oscillations) due to the reaction force of the ejection, and is allowed to vibrate freely. The voltage holding time T4 is set equal to the time from when the meniscus surface tension oscillations caused by the reaction force of the ejection move backward into the ink chamber to when the direction of its movement is thereafter reversed toward the nozzle hole and the meniscus returns to its initial position. The time required for the meniscus to return to its initial position varies depending on the size and ejection speed of the ink droplet, and becomes longer as the ejection speed increases.

Next, during sixth time T5, the voltage is lowered to the initial condition voltage VL, causing the piezoelectric actuator to discharge. This increases the volume of the ink chamber. At this time, the length of the sixth time T5 is set equal to one half of the cycle of the meniscus surface tension oscillations caused by the ejection in the fourth time T3, and the amount of voltage drop is set equal to a suitable value to cause the ink chamber 20 in the ink jet head to generate oscillations therein corresponding to the amplitude of the meniscus surface tension oscillations caused by the ink ejection in the fourth time T3. In setting the amount of voltage drop, the amplitude of the oscillations of the ink chamber is measured and the voltage value that generates the oscillations that can offset the meniscus oscillations is obtained in advance.

In this way, when the sixth time T5 over which the voltage is lowered from VH to VL is set equal to one half of the cycle of the meniscus surface tension oscillations, and the amount of voltage drop from VH to VL is set equal to a suitable value to generate in the ink chamber the oscillations corresponding to the amplitude of the meniscus surface tension oscillations, caused by the ink ejection, oscillations corresponding to the amplitude of the meniscus surface tension oscillations, but reversed in phase, are generated in the ink chamber 20. That is, when the meniscus moves toward the inside of the ink chamber after the ink ejection and thereafter begins to protrude in a convex form outside the nozzle hole, for example, the voltage drops from VH to VL and the ink chamber is caused to expand, thus absorbing the force which would otherwise cause the meniscus to protrude in a convex form. With the phase-reversed oscillations, the residual oscillations of the meniscus are canceled out and thus quickly suppressed.

Figure 8:
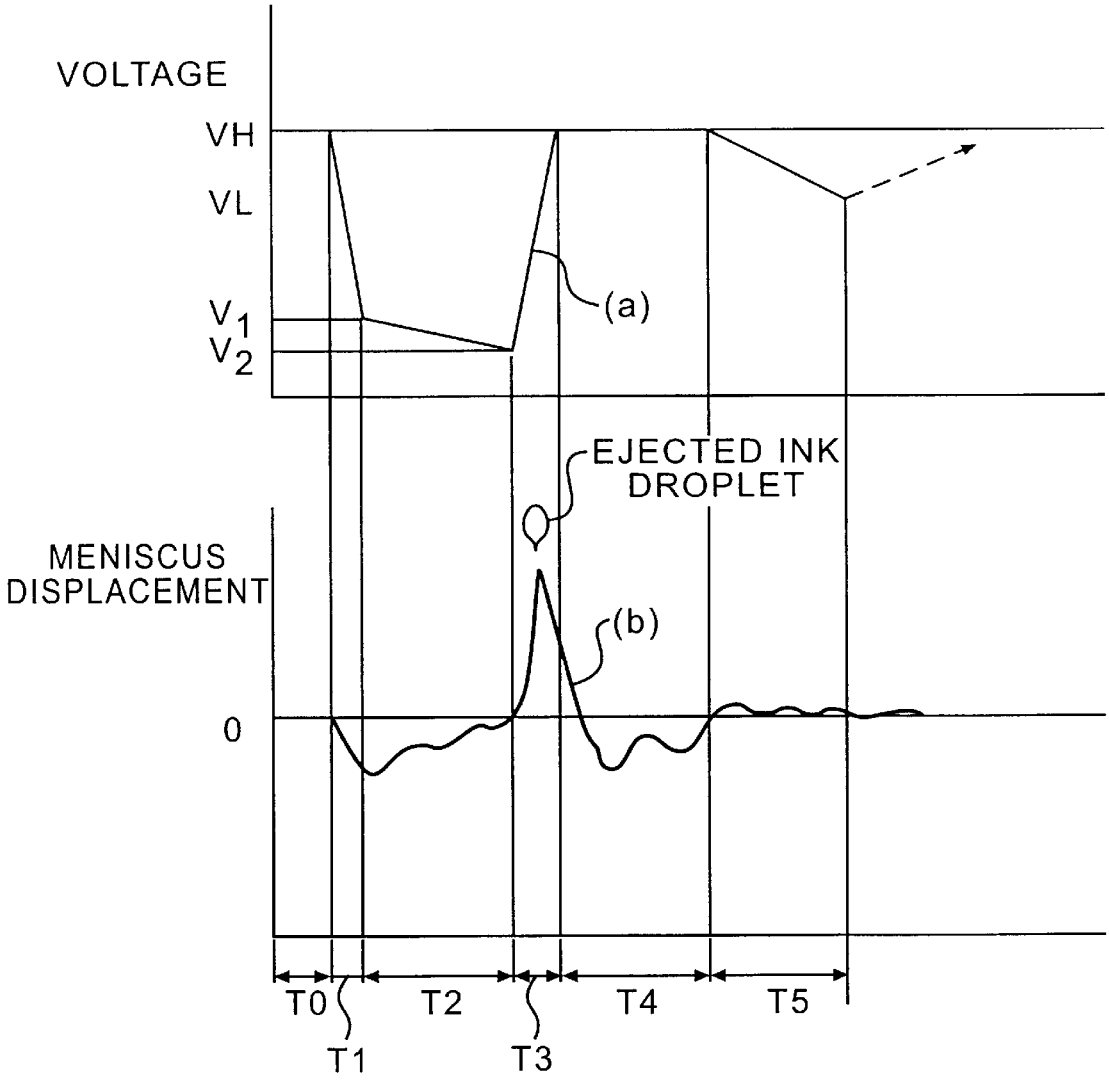

In the above description, the voltage value during the first time T0 in the initial condition has been set equal to the voltage value VL attained at the end of the sixth time T5. However, the effect of suppressing the residual oscillations of the meniscus can also be achieved if the initial voltage value is set to VH, not to VL as shown in FIG. 8. In that case, however, the voltage, once lowered to VL during the sixth time T5, must be raised again to VH.

It will, however, be noted that when the voltage value during the first time T0 in the initial condition is set at the voltage VL which is lower than the voltage value VH applied for ink ejection, the effect is that the specified amount of ink can be drawn in a shorter period of time, as previously explained.

What is claimed is:

1. A method for driving an ink jet head in which at least a portion of a wall surface of an ink chamber communicating at one end with a nozzle and at the other end with an ink reservoir is deformed by a piezoelectric actuator to eject ink, comprising the steps of:

lowering a voltage applied to said piezoelectric actuator from a voltage value in an initial condition, thereby causing the volume of said ink chamber to increase and thus causing ink to be drawn into said ink chamber;

rapidly raising said applied voltage up to a prescribed voltage value higher than said initial condition voltage value, thereby causing the volume of said ink chamber to decrease and thus causing ink to be ejected from said ink chamber;

holding said prescribed voltage value for a prescribed length of time until a meniscus returns to its initial position; and lowering said applied voltage from said prescribed voltage value down to said initial condition voltage value, thereby causing the volume of said ink chamber to increase, wherein the time over which said applied voltage is lowered from said prescribed voltage value to said initial condition voltage value is equal to one half the cycle of meniscus surface tension oscillations caused by said ink ejection, and the difference between said prescribed voltage value and said initial condition voltage value is such that oscillations corresponding to the amplitude of said meniscus surface tension oscillations are generated in said ink chamber.

2. A method for driving an ink jet head in which at least a portion of a wall surface of an ink chamber communicating at one end with a nozzle and at the other end with an ink reservoir is deformed by a piezoelectric actuator to eject ink, comprising the steps of:

lowering a voltage applied to said piezoelectric actuator from a voltage value in an initial condition, thereby causing the volume of said ink chamber to increase and thus causing ink to be drawn into said ink chamber;

rapidly raising said applied voltage up to said initial condition voltage value, thereby causing the volume of said ink chamber to decrease and thus causing ink to be ejected from said ink chamber;

holding said raised voltage value for a prescribed length of time until a meniscus returns to its initial position; and lowering said applied voltage down to a prescribed voltage value lower than said raised voltage value, thereby causing the volume of said ink chamber to increase, wherein the time over which said applied voltage is lowered from said raised voltage value to said prescribed voltage value is equal to one half the cycle of meniscus surface tension oscillations caused by said ink ejection, and the difference between said raised voltage value and said prescribed voltage value is such that oscillations corresponding to the amplitude of said meniscus surface tension oscillations are generated in said ink chamber.

3. A method for driving an ink jet head as claimed in claim 1 or 2, wherein the step of lowering the voltage applied to said piezoelectric actuator from said initial condition voltage value consists of two steps, wherein in the first step, said voltage is rapidly lowered, and in the second step, said voltage is lowered more slowly than in said first step.

* * * * *